United States Patent [19]

Schmid

[11] 3,958,859

[45] May 25, 1976

[54] ELECTRICAL CONNECTOR PIN

[76] Inventor: Louis H. Schmid, 13581 Tea House Lane, Santa Ana, Calif. 93105

[22] Filed: June 17, 1974

[21] Appl. No.: 479,599

[52] U.S. Cl. ..... 339/217 S

[51] Int. Cl.[2] ..... H01R 9/08

[58] Field of Search..... 339/217 R, 217 S, 252 R, 339/252 P, 276 SF, 255 R, 255 RT, 256 R, 256 RT, 258 A, 258 R, 259 R, 262 R, 262 P, 262 RR

[56] References Cited

UNITED STATES PATENTS

| | | | |
|---|---|---|---|
| 2,517,677 | 8/1950 | Kjell-Berger et al. | 329/629 |
| 3,426,320 | 2/1969 | Wilm | 339/258 R |
| 3,478,305 | 11/1969 | Chirumbelo | 339/258 R |
| 3,588,789 | 6/1971 | Kailus | 339/217 S |
| 3,697,931 | 10/1972 | Achten | 339/252 P |
| 3,697,934 | 10/1972 | Merry | 339/217 S |
| 3,783,440 | 1/1974 | Karube et al. | 339/258 RR |

FOREIGN PATENTS OR APPLICATIONS

| | | | |
|---|---|---|---|
| 278,225 | 10/1927 | United Kingdom | 339/252 P |

*Primary Examiner*—Joseph H. McGlynn
*Assistant Examiner*—James W. Davie

[57] ABSTRACT

The disclosure of this specification shows an electrical connector pin which has been made out of a stamped piece of metal formed as a Y with a rectangular base portion thereof rolled into a roll pin for placing wire therein. The resultant pin has three arms spaced approximately one hundred and twenty degrees apart and comprise the support leg and the two downwardly extending arms. These three make contact with the inner wall of a suitable tubular mating socket. The two downwardly extending arms may contact and be held by an annular ledge which can be formed with an angle or in the form of a flange for holding the legs of the pin.

Another embodiment utilizes a tulip shaped pin in cross section. The tulip shape provides an S shaped compound curved resilient intermediate portion with outwardly extending terminal elements. The upper portion is free to compress into the mating tubular socket without forcing the extended lower portion of the two downwardly extended legs off of an annular retaining ledge. However, the pin can be removed if desired by a suitable tubular member that extends close to the retaining ledge, The tulip configuration allows a flexing thereof without substantial fatigue by avoiding gripping and attendant "ironing" of the pin into a smaller diameter than is required to hold a tubular connecting element that receives the pin. Finally, the three elements assure contact of pin to socket where only two elements may not suffice.

7 Claims, 12 Drawing Figures

ELECTRICAL CONNECTOR PIN

BACKGROUND OF THE INVENTION

1. FIELD OF THE INVENTION

The field of this invention lies within the electrical connector art. Specifically, the field can be confined to that residing within the minature connector art wherein wire is held within a pin. The pin is seated within a plastic member which holds the pin and provides an elongated passage surrounding the pin. Within the passage, a tubular mating female section slips over the pin between it and the surrounding plastic member. The foregoing provides a multiplicity of separable pin connectors.

2. THE PRIOR ART

The prior art related to miniature connectors of the foregoing type involves the utilization of pins in various forms. One pin is formed from a metal Y element having a rectangular base. The rectangular base is formed into a roll pin by rolling it over or onto itself for placing wire therein. The terminal points of the Y are bent downwardly to form a triangulated member at the ends of the Y and its upright portion.

In some cases, the legs of the Y are turned into the roll pin. The foregoing allows for maintenance of the legs of the Y in a downwardly oriented location within the roll pin.

One drawback to the foregoing is that the roll pin and Y cannot be formed so that the elements of the pin are sufficiently resilinet. Furthermore, removal of the pin is made more difficult by virtue of the fact that the pin is formed into a plastic body for holding it in situ.

The pins are often placed within a plastic element for securement therewith. Epoxy can be additionally utilized to secure the pin into a seated relationship within the plastic.

Oftentimes it is necessary to remove the pins so that the wiring arrangement can be changed, or to repair the pin itself. As can be appreciated, a fixed pin relationship entails the utilization of various molding processes as well as the inability to remove the pin in a facile manner.

Another drawback of the prior art is that once the pin has been established within its axial passage of the plastic, it tends to be "ironed out" by the female element. In other words, the outward resilience of the pin is ironed by the female fitting which slides over the pin between the walls of the axial passage and the pin itself. This "ironing out" effect creates a situation wherein the pin grip is eventually loosened by virtue of its spring memory being lost. As it is loosened within the female connector, it causes either a poor connection, or no connection at all if the female element becomes displaced.

Some pins having only two arms, namely one ascending support arm and one descending arm have two serious disadvantages in contrast to this invention. They do not have a wide rounded nose needed to assure alignment with the mating socket. Furthermore, they do not have the contact legs to assure continuity of current flow under severe shock and vibration environments.

The foregoing drawbacks of the prior art have been substantially overcome by this invention. Specifically, the invention provides a pin having a resilient flared memory and one in the form of a tulip shaped member. The tulip shape provides a resilient element that bends inwardly in an S shaped spring configuration. Also, the base of the pin configuration is seated on a ledge or annulus to prevent withdrawal of the pin.

If the pin is to be withdrawn, a tool can be implaced within the passage in the plastic into which the pin is placed for narrowing the diameter of the pin so that it will pass over an internal ledge or annular ring which secures the base or terminal portions of the pin.

The terminal portions of the pin rest on an annulus or base ledge and prevent the pin from sliding out of the plastic base. This particular feature eliminates the requirement of having to securely affix the pin into the surrounding plastic or by means of an adhesive.

In addition to the foregoing, the invention provides an annular element against which the arms of the pin rest in a manner whereby a sloping catch or latch effect is effectuated. The sloping catch or latch can be in the form of a ledge, or a sloping shoulder on the interior of the annulus. This effectuates a gripping of the terminal portions of the pins so that the pin cannot be removed unless the terminal portions thereof are lifted and squeezed to a diameter less than the diameter of the narrowest portion of the annulus or ledge.

The foregoing features and aspects will become more apparent in the following specification in which a preferred embodiment hereof has been described.

SUMMARY OF THE INVENTION

In summation, this invention provides an improved miniature electrical connector pin which is secured by means of an internal annulus, within a passage of the plastic base member in which the pin is seated.

More specifically, the invention provides a resilient pin which is seated within an axially oriented passage for receipt of the pin. The passage in which the pin is seated, allows the pin to be slid thereinto with the wires to which it is attached. The wires are held by means of a roll pin being formed as a portion of the pin and securing the strands of wires which are to be connected by the pin.

The pin can be held by means of an annular ledge wherein the terminal ends of the pin are bent outwardly against the side walls of the passage in which the pin is placed. The terminal ends of the pin are extended to a greater diameter within the passage of the plastic holding element in a manner whereby they override the ledge provided by the annulus which is of a smaller diameter than the inside diameter of the passage.

In addition to the foregoing, the invention comprises a resilient tulip shaped or S shaped cross sectioned pin having terminal portions which rest against the annulus in a manner whereby the metallic memory of the pin is maintained. The memory retention capabilities help to secure a female tubular member into which the pin is slid between the walls of the passage and the outside of the pin. This effectuates a holding of the pin so that its securement is more firmly maintained.

Additionally, a sloping upper portion or internal shoulder or ledge can be provided on the annulus against which the terminal portions of the pin must override prior to removal. The removal can be easily effectuated by a tool which squeezes the ends of the pin into a diameter less than the inside diameter of the annulus so that the entire pin in either of the foregoing configurations can be easily removed.

Also, the three or more legged construction hereof assures electrical contact of the pin within its mating tubular socket under the most severe conditions of shock and vibration. It is possible in systems with only two contact members one hundred eighty degrees apart, to close in the case of a pin or open in the case of a socket, and momentarily lose contact, causing an interruption of electron flow.

Additionally, the bullet or ogive nose which is very uniform from contact to contact assures alignment with the mating socket.

Finally, this invention permits miniature electrical contacts to be placed on very close center to center spacings and still provides the contact retention system permitting the contact to be removed from the plastic insulating body when desired.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
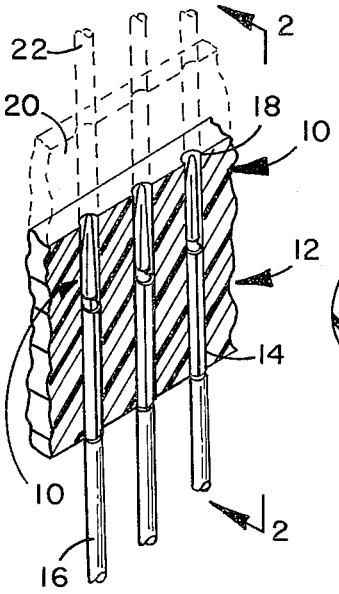
FIG. 1 shows a plurality of the pins of this invention which have been placed into a plastic receptacle and wherein a mating tubular element is overriding the pins.
Figure 4:
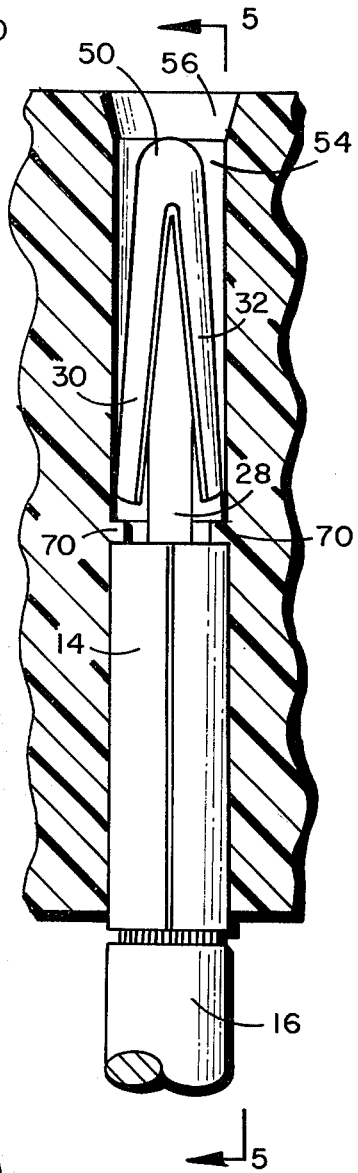
FIG. 4 shows a cross sectional view of the surrounding base member holding the pin and an elevation view of the pin itself in the direction of line 4—4 of FIG. 3.

Looking more specifically at the FIGS., FIG. 1 shows a series of pins 10 that have been inserted into a plastic holding base or block 12. The pins 10 are formed with a roll pin segment 14. The roll pin segment 14 is utilized to grip a wire 16 having a number of strands going into the roll pin. The pins 10 are implaced within the block 12 in such a manner that a female connector element 18 extending from a second base 20 projects into the base 12 for receiving the pins 10. The second base 20 has a plurality of wires 22 extending therefrom for purposes of connecting the female portion of the connector to the male pins 10 in a manner to be described.

Figure 2:
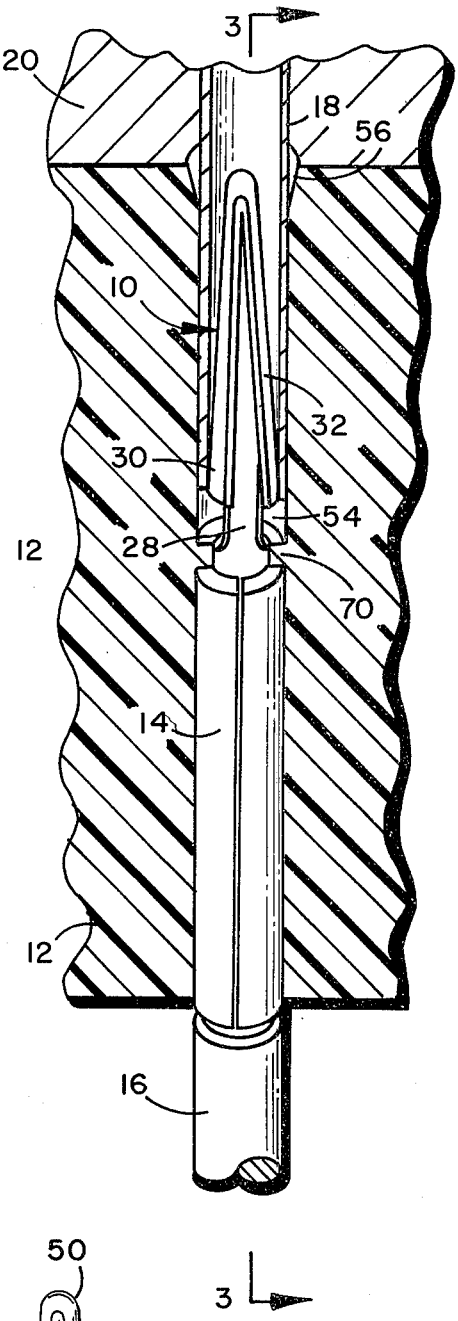
FIG. 2 shows the pins in their connected relationship along lines 2—2 of FIG. 1.

Looking more particularly at FIG. 2, it can be seen wherein a base 20 having the female portion 18 extending therefrom, overrides the pin 10 in a frictionally engaging manner. The tubular member 18 which serves to override the pin 10 has a metallic conducting property and can be made of any of the metal conductors which are known in the art. Each of the three arms spaced 120 ° makes contact with the tubular inner wall of member 18.

The pin 10 is initially implaced around a wire in a manner to be described. Suffice it to say, a number of strands of the wire 16 are held in a tightened position within the roll pin 14 and are prevented from being pulled therefrom. However, a crimped configuration as well as other means can be utilized such as a solder dip or adhesive, in order to maintain the wires in the roll pin 14.

Figure 10:
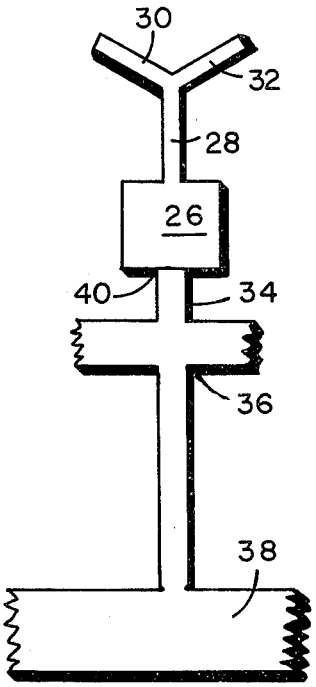
FIG. 10 shows a detailed showing of one of the pre-formed pins through the circle 10 of FIG. 9.
Figure 11:
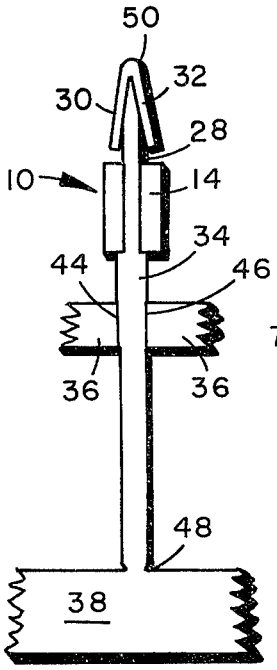
FIG. 11 shows an alternatively scored pin which has been formed from the pre-formed elements of FIG. 9.
Figure 6:
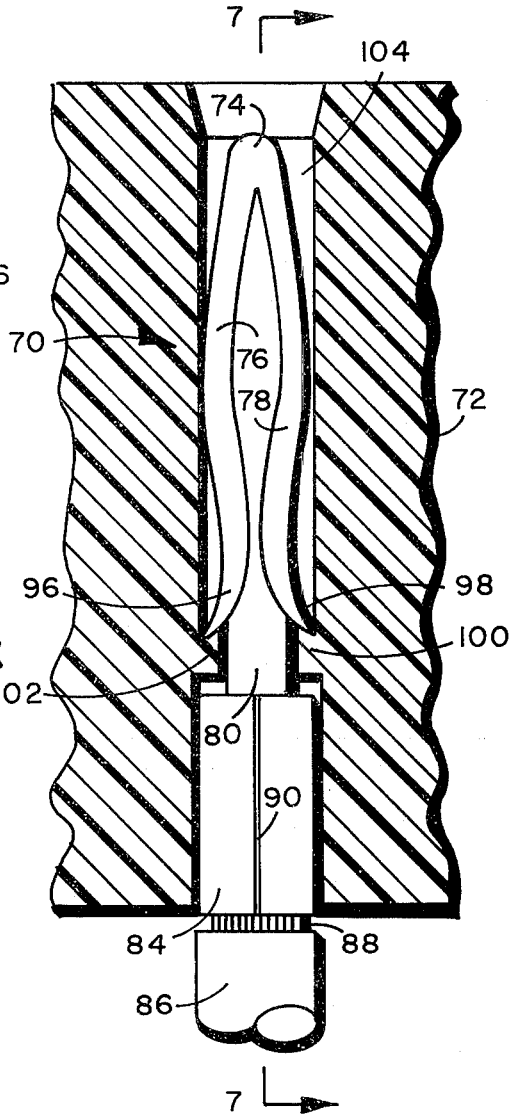
FIG. 6 shows an alternative elevation view of the pin having a tulip configuration inserted within a plastic base member having an annulus with a sloping ledge thereto.
Figure 9:
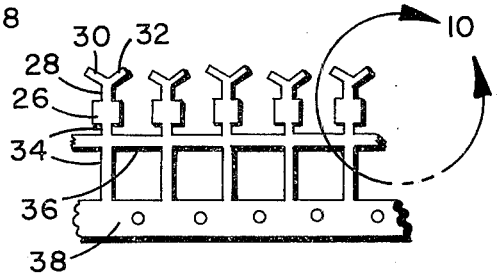
FIG. 9 shows a series of stamped pre-formed members from which the pins are made.

Looking more specifically at FIGS. 9, 10 and 11, a pair of alternative embodiments for forming the pin 10 are shown. Specifically, in FIG. 9, a series of pre-formed pins are shown having a rectangular base portion 26, an upright portion of the Y 28, and two transverse members 30 and 32. The foregoing are attached to a stamped portion of the metal from which they are formed and comprises a tail 34 that extends downwardly, a number of cross members 36, and a main member 38 comprising flash. The foregoing provide a pre-formed pin which can be formed by numerous means.

In a first embodiment of the pin, as shown in FIG. 10, the flash extends from the tail 34 downwardly. This is accomplished by a score line 40. The score line 40 is right below the base or rectangular member 26. Thus, the entire flash comprising the tail, cross member 36, and base member 38, can be disposed of by breaking the pre-formed pin on the score line 40.

Looking more specifically at FIG. 11, it can be seen that the score lines 44 and 46 are cut through the cross member 36. A third score line 48 is shown through the base 38. The score lines 44, 46 and 48 allow the cross members 36 and the base 38 to be removed from the tail 34 for purposes of allowing the base of the pin to be provided with a pigtail lead.

The rectangular base portion 26 is rolled into the roll pin 14 by way of any suitable rolling means. In addition thereto, the transverse members 30 and 32 of the Y are turned downwardly and cooperate with the upright member 38 of the Y to form the pin 10. The members 28, 30 and 32 are formed so as to create a rounded apex 50. The rounded apex 50 is created by any suitable forming means or can be merely formed as the outgrowth of the downwardly turned members 30 and 32. The tubular member 18 which overrides the pin 10 is of sufficient outside diameter to fit freely within the axial passage 54 and has a tapered entrance 56 thereinto. The tapered entrance 56 is such that the female tubular member 18 can slide deeply thereinto and overlie the point or apex 50 of the pin 10.

The roll pin 14 as shown in FIG. 11 is in an opened configuration. In its opened configuration, it is capable of receiving the wires or strands of the wire 16 which is implaced therein. After the strands have been placed therein, the entire series can be crimped within the roll pin 14 by rolling it over onto the wires and holding the strands in place.

Figure 3:
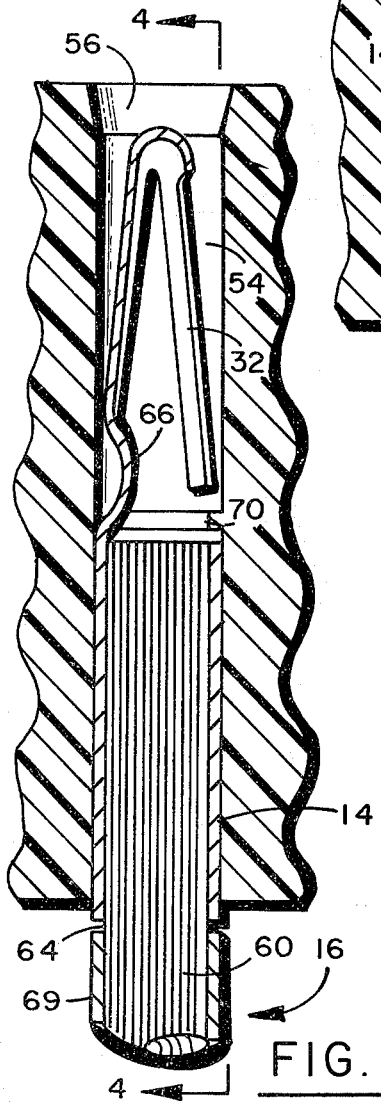
FIG. 3 shows a cross sectional view of the pin in the direction of lines 3—3 of FIG. 2.
Figure 5:
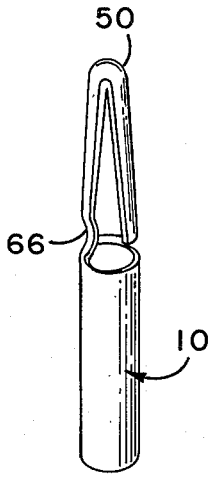
FIG. 5 shows an elevation view of the pin in the direction of lines 5—5 of FIG. 4.

Looking more particularly at the specific embodiment of FIG. 3, the roll pin 14 is shown gripping a number of strands 60 of the wire 16 which can also be a solid wire. The wire 16 has an outer layer 62 of insulation which covers it. The insulation 62 has been stripped so that there is a gap 64 between the base of the roll pin 14 and the insulation 16. The foregoing gap 64 can be covered or left exposed in the manner as shown.

The upright portion 28 of the Y has a bow 66 therein. The bow 66 is indented or formed as a concave portion in order to override a ledge 70. The ledge 70 is formed on the internal portion of the plastic material 12, or base meterial. The ledge 70 is of a smaller internal diameter than the tubular passage 54.

The ledge 70 creates an impediment to prevent the withdrawal of the pin members 28, 30 and 32. However, the pin members 30 and 32 can be squeezed across their diameter to provide passage through the inside diameter of the ledge or annulus 70. The squeezing of the pins 28, 30 and 32 through the inside diameter or the opening of the ledge or annulus 70, effectuates passage thereof for withdrawal of the pin 10 from the base 12.

A tool such as a tubular member can be inserted so that it moves the pin legs 28, 30 and 32 inwardly to at least the inside diameter of the ledge or annulus 70 for passage of the entire pin 10 outwardly from the base 12. This serves to allow withdrawal of the pin 10 including the roll pin 14 from the base 12. It should be appreciated that the roll pin 14 can be of a lesser diameter than the inside diameter of the passageway 54. Thus, it can be withdrawn more readily than if it is of the exact diamter.

The foregoing features allow the embodiment of the invention to be withdrawn from the base 12 without recourse to destruction of the base or dissolving the respective portions of the adhering elements thereof.

Looking more specifically at FIGs. 6, 7, 8 and 12, an alternative embodiment of this invention is shown. The alternative embodiment incorporates a tulip shaped member. The tulip shaped member is formed as a pin 70 which is seated within a base member 72 similar to the base 12. The pin 70 has an apex 74 formed in the same manner as that shown in FIGs. 10 and 11. The apex 74 is the apex of a pre-formed Y similar to where the members 28, 30 and 32 meet. However, the members 28, 30 and 32 are changed in this element to provide respective members 76 and 78 with an upright portion 80. The respective members 76, 78 and 80 form the tulip shaped connector pin 70. The pin 70 has a roll pin base 84 with a wire 86, connected thereto with strands 88 fed into the roll pin 84. A seam 90 of the roll pin is shown which is formed in the same manner as the seam of the previous embodiment.

The tulip shaped members 76, 78 and 80 provide a resilient S shaped curved section. The upright member 80 is formed as a portion of the extension of the roll pin similar to the member 28 in the previous embodiment. However, the transverse members 76 and 78 are pointed at their terminal portions 96 and 98. The terminal portions 96 and 98 can be formed in any manner; however, in this specific embodiment, they have been shown with a pointed configuration.

The S shaped configuration of the members 76, 78 and 80 tapers inwardly before they extend outwardly toward their terminal portions 96 and 98. The inward bow combined with the S shaped configuration presents a resilient dual reacting force against the forces of the tubular female connector pin 18 which fits thereover. In other words, the connective female element 18 meets with a certain resistance formed by the resiliency of the S shaped members 76, 78 and 80 to avoid the requirement of having to maintain the pin 10 in its most resilient configuration. In essence, it prevents ironing or fatigue of the pin in a manner whereby the pin's resilience is maintained substantially over the life of the pins in the prior art.

The base member 72 is analogous to the base member 12 and has a ledge 100 with an upstanding angular portion 102. The upstanding angular or sloping portion 102 receives the terminal portions 96 and 98 of the pin leg 76 and 78, so as to prevent them from moving inwardly into the inside diameter of a passage 104 of the base 72. This serves to block the terminal portions of the members 76 and 78 therein from moving toward the inner diameter of the passage 104.

The ledge 100 can be formed in any other suitable manner with the angular relationship 102 provided by an interior boss, ledge, flange, or circumferential annulus. The circumferential annulus, of course, should allow sufficient space for the ends 96 and 98 to fit thereinto so that they are secured from internal movement into the passage 104.

Figure 7:
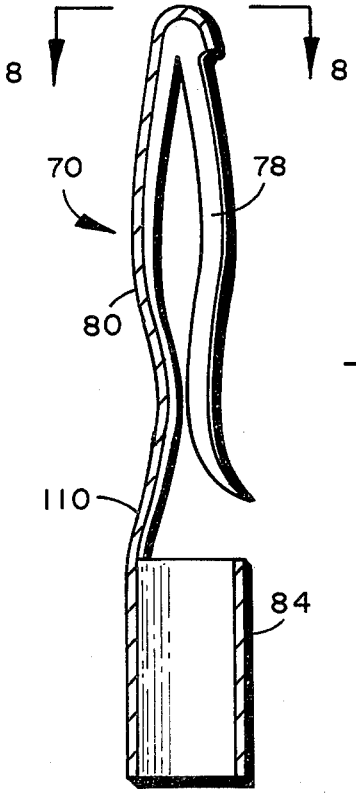
FIG. 7 shows a sectional view of the pin of FIG. 6 in the direction of lines 7—7 of FIG. 6.
Figure 8:
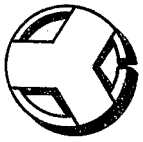
FIG. 8 shows a plan view looking downwardly on the pin in the direction of lines 8—8 of FIG. 7.

As can be seen from the drawings of FIg. 7 and the other related drawings, an indentation 110 has been provided in the supporting member 80 or midsection of the upright portion of the Y. This effectively enables the pin 70 to override the ledge or annulus 100 so that the annulus is accommodated within the concavity of the indentation 110.

Figure 12:
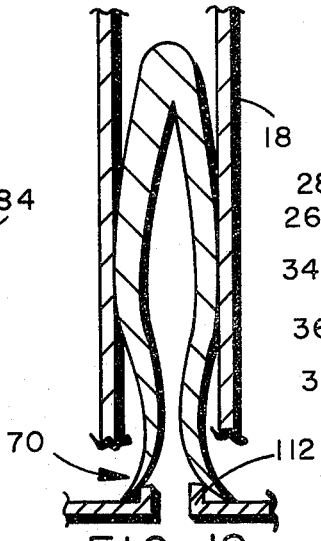
FIG. 12 shows an alternative sectionaal view of this invention illustrating a shoulder for holding the terminal ends of the pin.

An alternative embodiment is shown in FIG. 12 wherein the female tubular connector element 18 which is utilized with all the foregoing inventions, is shown in adjacent relationship to the pin 70. However, in contradistinction to the foregoing, a ledge or circular flange 112 is utilized for purposes of maintaining the arms 76, 78 and 80 internally of the annulus so that they will not contract toward the inside diameter and fold downwardly through the opening. The foregoing ledge 112 can be substituted by any suitable circumferential blockage, such as the angularly oriented configuration of the angular member 102.

All of the foregoing embodiments can be removed by means of a tool which overrides the arms of the pin. The tool can surround the arms and push them into a relationship so that they can pass through the interior of the annulus that is provided within the axial passage into which the pin is inserted.

This invention is to be read broadly in light of the prior art of maintaining electrical connectors in their base members. As a consequence, the teachings of this invention are for illustrative purposes only and the breadth and scope of the invention is only to be determined by the spirit of the following claims.

I claim:

1. An electrical connector for engaging use in combination with a tubular female mating member comprising:

A base member having a passage therein;

A pair of arms that have been formed from the branches of a Y shaped member with arm ends resiliently extending from the upright portion of the Y at the apex thereof in a manner wherein the arms are folded backwardly from the apex toward the upright of the Y in resiliently spaced relationship therefrom said arm ends free to move inwardly and outwardly with respect to the axis of the upright portion of the Y;

A wire connection means formed at the base of the upright of the Y member in spaced relationship from the apex thereof; and, Means to prevent said member from longitudinal withdrawal movement within said passage in the form of a protuberance in said passage which engages the free ends of said arms in a manner so that they can be collapsed and passed over the protuberance.

2. The connector as claimed in claim 1 further comprising:

an annulus forming said protuberance.

3. The connector as claimed in claim 1 wherein:

the upright member of the Y has an interior concave portion bending inwardly toward the axis of said pin.

4. The connector as claimed in claim 1 wherein:

said base wire connection means is an extension of the upright of the Y formed with a passage for receiving wire.

5. The connector as claimed in claim 1 further comprising:

said arms having a configuration in the form of a compound curve for purposes of providing resilience to the arms.

6. The connector as claimed in claim 5 wherein:

said compound curve of said arms is an S shaped configuration.

7. The connector as claimed in claim 6 wherein said protrusion is:

an interior annular ridge within said base member for seating the ends of said arms.

* * * * *